US010571193B2

(12) United States Patent
Hatakeyama et al.

(10) Patent No.: US 10,571,193 B2
(45) Date of Patent: Feb. 25, 2020

(54) REDUCED IRON PRODUCTION METHOD AND DEVICE

(71) Applicant: Kobe Steel, Ltd., Kobe-shi (JP)

(72) Inventors: Taiji Hatakeyama, Kobe (JP); Shorin O, Kobe (JP); Tomoki Uemura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 294 days.

(21) Appl. No.: 15/547,864

(22) PCT Filed: Jan. 21, 2016

(86) PCT No.: PCT/JP2016/051756

§ 371 (c)(1),
(2) Date: Aug. 1, 2017

(87) PCT Pub. No.: WO2016/125598

PCT Pub. Date: Aug. 11, 2016

(65) Prior Publication Data

US 2018/0017326 A1 Jan. 18, 2018

(30) Foreign Application Priority Data

Feb. 3, 2015 (JP) ..... 2015-019066

(51) Int. Cl.
*C21B 13/10* (2006.01)
*F27B 9/16* (2006.01)
(Continued)

(52) U.S. Cl.
CPC ..... *F27B 9/16* (2013.01); *C21B 13/10* (2013.01); *F27B 9/10* (2013.01); *F27B 9/147* (2013.01);
(Continued)

(58) Field of Classification Search
None
See application file for complete search history.

(56) References Cited

U.S. PATENT DOCUMENTS 4,197,495 A * 4/1980 Matsui ..... C21B 7/24 266/92
6,312,501 B1 * 11/2001 Fujioka ..... C21B 13/008 75/746
(Continued)

FOREIGN PATENT DOCUMENTS

JP 2000-109914 A 4/2000
JP 2007-147195 A 6/2007
JP 2012-52741 A 3/2012

OTHER PUBLICATIONS

International Search Report dated Apr. 5, 2016 in PCT/JP2016/051756 filed Jan. 21, 2016.
(Continued)

*Primary Examiner* — George Wyszomierski
(74) *Attorney, Agent, or Firm* — Oblon, McClelland, Maier & Neustadt, L.L.P.

(57) ABSTRACT

A method and a device for charging a plurality of reduced iron raw materials into a traveling hearth reduction-melting furnace and treating the raw materials, allowing sufficient input of heat to the reduced iron raw materials on a hearth covering material to improve treatment efficiency are provided. The reduced iron raw materials are released downward from the lower surface of a ceiling of the reduction-melting furnace to be set on a hearth covering material on a hearth and reduced on the hearth covering material. The falling reduced iron raw materials are given a horizontal velocity having a direction equal to the travel direction of the hearth and being greater than the travel speed of the hearth
(Continued)

to enable the reduced iron raw materials to roll in the same direction as the travel direction of the hearth after landing on the hearth covering material.

9 Claims, 13 Drawing Sheets

(51) Int. Cl.

| | |
|---|---|
| ***F27D 3/10*** | (2006.01) |
| ***F27B 9/10*** | (2006.01) |
| ***F27D 3/00*** | (2006.01) |
| ***F27B 9/20*** | (2006.01) |
| ***F27B 9/38*** | (2006.01) |
| ***F27B 9/14*** | (2006.01) |

(52) U.S. Cl.
CPC ..... *F27B 9/20* (2013.01); *F27B 9/38* (2013.01); *F27D 3/0033* (2013.01); *F27D 3/10* (2013.01)

(56) References Cited

U.S. PATENT DOCUMENTS

2004/0211295 A1* 10/2004 Kikuchi ..... C21B 13/0006 75/484
2013/0153368 A1 6/2013 Tsuge et al.

OTHER PUBLICATIONS

International Preliminary Report on Patentability and Written Opinion dated Aug. 17, 2017 in PCT/JP2016/051756 filed Jan. 21, 2016 (English translation only).

* cited by examiner

REDUCED IRON PRODUCTION METHOD AND DEVICE

TECHNICAL FIELD

The present invention relates to a method and a device for producing reduced iron by charging a plurality of reduced iron raw materials, each of which contains carbonaceous reducing agent and iron oxide, into a traveling hearth reduction-melting furnace and treating the raw materials.

BACKGROUND ART

For producing reduced iron, there is conventionally known a method including charging a plurality of reduced iron raw materials, each of which contains carbonaceous reducing agent and iron oxide, into a traveling hearth reduction-melting furnace to treat them. For example, Patent Literature 1 discloses a method including preparing numerous spherical pellets as the plurality of reduced iron raw materials, inserting these pellets successively into the traveling hearth reduction-melting furnace to heat the pellets, and separating the reduced iron (metal iron) produced by the heating from slag to discharge the reduced iron and the slag to outside of the reduction-melting furnace.

The traveling hearth reduction-melting furnace has a hearth movable in a specific direction and a ceiling located over the hearth, each of which is constructed with a refractory such as a brick. On the hearth is provided a hearth covering material for protecting the refractory. In detail, on the hearth, there are continuously performed a series of treatments on the iron oxide, that is, reduction, cementation, melting, aggregation, and slag separation; in order to inhibit the thus treated iron oxide treated from direct contact with the refractory constituting the hearth, the hearth covering material is laid with a suitable layer thickness on the hearth.

As means for charging each of the pellets into the reduction-melting furnace, Patent Literature 1 in FIG. 8 discloses letting each of the pellets fall freely and successively from the ceiling onto the hearth, specifically onto the hearth covering material, through a plurality of supplying units provided in the ceiling.

Patent Literature 2 discloses a charging device provided with a charging inlet that can be tilted so as to descend from a ceiling of the reduction-melting furnace. The charging inlet has an upper inlet, a passageway for letting the pellets descend, and a lower outlet, being capable of being lowered to a position where the lower outlet is close to the hearth, while being inclined.

For producing reduced iron from the plurality of reduced iron raw materials in such a traveling hearth reduction-melting furnace, it is desirable to treat the reduced iron raw materials efficiently in a period of time as short as possible. As effective means therefor, the present inventors have paid attention to promoting good heat input by securing a contact area at which each of the reduced iron raw materials and a high-heat gas in the surroundings thereof make contact with each other and securing a heat-receiving area which is a part of the surface area of the reduced iron raw materials at which area the reduced iron raw materials receive the heat given to the reduced iron raw materials by radiation, and have found out that, from such a viewpoint, the conventional techniques disclosed in Patent Documents 1 and 2 involve important problems.

Specifically, the reduced iron raw materials that are successively charged into the melting furnace by free fall as disclosed in Patent Document 1 include not a few reduced iron raw materials at least a part of which is embedded in the powdery hearth covering material and/or not a few reduced iron raw materials that are stacked onto the preceding reduced iron raw materials. This embedment and/or stacking of the reduced iron raw materials may reduce the contact area at which each of the reduced iron raw materials and a high-heat gas in the surroundings thereof make contact with each other and the heat-receiving area which is a part of the surface area of the reduced iron raw materials at which area the reduced iron raw materials receive the heat given to the reduced iron raw materials by radiation; these may hinder sufficient heat from being input into the reduced iron raw materials.

The technique disclosed in Patent Document 2, though enabling the lower outlet of the pellet charging inlet to come close to the hearth, does not allow powdery hearth covering material for protecting the hearth such as described above to be easily added. If the hearth covering material was spread on the hearth in this technique, the lower outlet of the pellet charging inlet coming close to the hearth covering material would involve considerable turbulence of the gas flow between the lower outlet and the hearth covering material, which could cause considerable scattering of the hearth covering material and embedment of the pellets (reduced iron raw materials) due to the scattering. Furthermore, because of high-temperature gas under the ceiling, large extension of the pellet charging inlet such as described above downward beyond the ceiling has to use a material with a high heat resistance enough to withstand the high temperature, involving considerable increase in the costs. Besides, even with use of such heat-resistant material, the high-temperature environment does not allow the decrease in the reliability of the charging equipment to be avoidable.

CITATION LIST

Patent Literature

Patent Literature 1: Japanese Unexamined Patent Publication No. 2012-052741

Patent Literature 2: Japanese Unexamined Patent Publication No. 2000-109914

SUMMARY OF INVENTION

An object of the present invention is to provide a method and a device for producing reduced iron, the method and device enabling each of the reduced iron raw materials supplied onto a hearth covering material to receive sufficient heat input on the hearth covering material to improve the treatment efficiency thereof without decrease in the reliability of the equipment or considerable rise in the costs.

Provided is a method for producing reduced iron, the method including: a step of successively charging a plurality of spherical reduced iron raw materials, each of which contains carbonaceous reducing agent and iron oxide, into a reduction-melting furnace having a hearth that travels in a specific direction, a ceiling located over the hearth, and a hearth covering material that is made of powder spread on the hearth, to set the reduced iron raw materials on the hearth covering material; and a step of performing successive reduction processing on the reduced iron raw materials on the hearth covering material with travel of the hearth to thereby produce reduced iron and discharge the produced reduced iron to outside of the reduction-melting furnace. The step of setting the reduced iron raw materials on the hearth covering material includes releasing the reduced iron raw materials downward from a lower surface of the ceiling and letting the reduced iron raw materials fall onto the hearth covering material while giving a horizontal velocity to the reduced iron raw materials, the horizontal velocity having a horizontal direction that is equal to the direction of the travel of the hearth and being greater than a speed of the travel of the hearth, to the reduced iron raw materials, to thereby bring the reduced iron raw materials into rolling motion in a direction of the horizontal velocity on the hearth covering material.

Also provided is a device for producing reduced iron, the device including: a reduction-melting furnace having a hearth travelable in a specific direction, a ceiling located over the hearth, and a hearth covering material made of powder spread on the hearth, so as to produce reduced iron by successively heating the reduced iron raw materials that are set on the hearth covering material with travel of the hearth; a raw material charging unit that charges the plurality of reduced iron raw materials successively into the reduction-melting furnace to set the reduced iron raw materials on the hearth covering material; and a discharging unit that discharges the reduced iron produced in the reduction-melting furnace. The raw material charging unit releases the reduced iron raw materials downward from a lower surface of the ceiling and lets the reduced iron raw materials fall onto the hearth covering material while giving a horizontal velocity to the reduced iron raw materials, the horizontal velocity having a horizontal direction that is equal to the direction of the travel of the hearth and being greater than a speed of the travel of the hearth, to thereby bring the reduced iron raw materials into rolling action in a direction of the horizontal velocity on the hearth covering material.

DESCRIPTION OF EMBODIMENTS

There will be described a preferable embodiment of the present invention with reference to the drawings.

Figure 1:
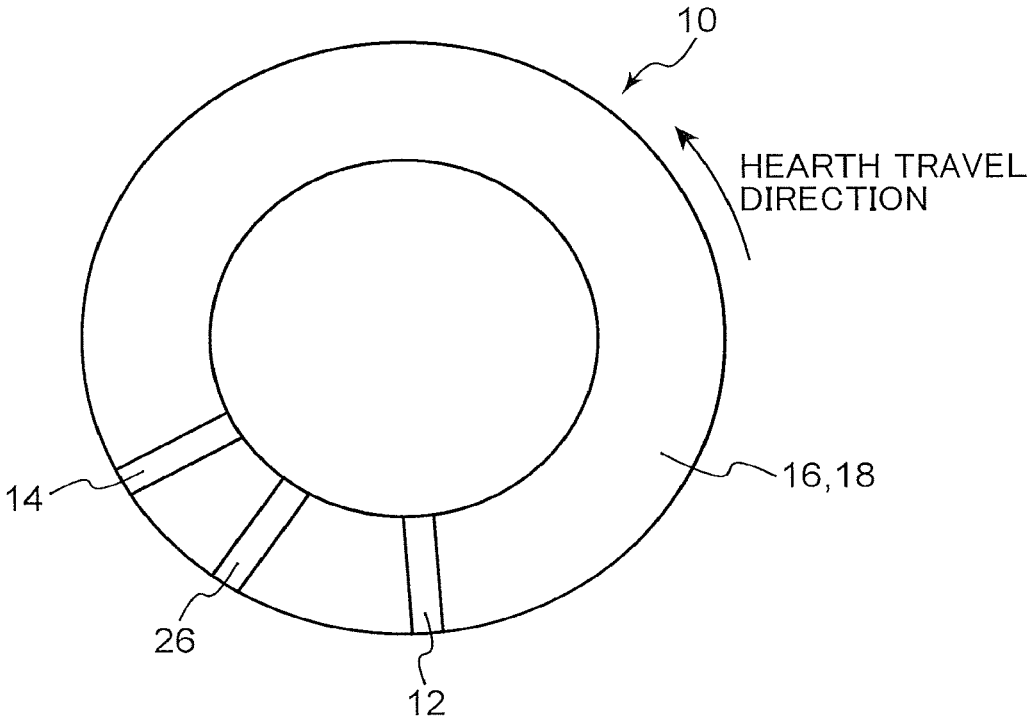
FIG. 1 is a plan view of a reduced iron production device according to an embodiment of the present invention.
Figure 2:
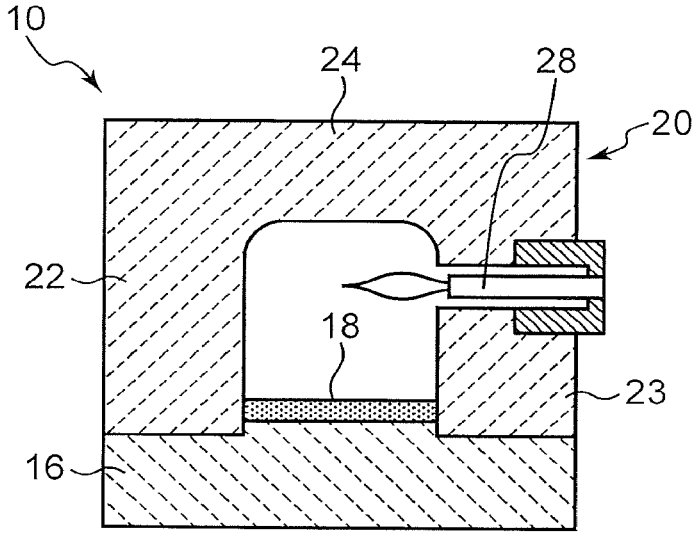
FIG. 2 is a view showing a section taken along a radial direction of a traveling hearth reduction-melting furnace in the reduced iron production device.
Figure 3:
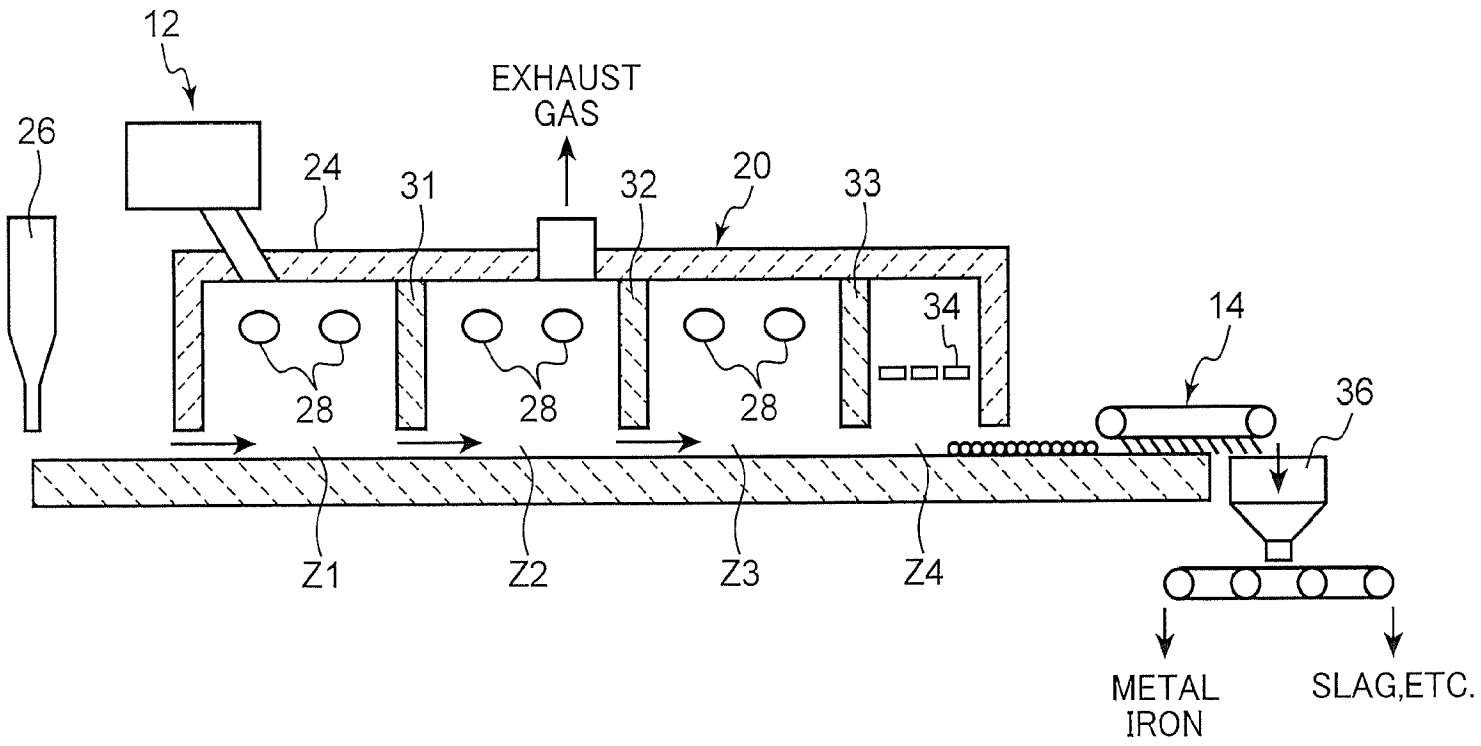
FIG. 3 is a sectional view showing the reduction-melting furnace as expanded along the moving direction of a hearth thereof.

FIGS. 1 to 3 show a reduced iron production device according to an embodiment of the present invention. This reduced iron production device is designed to produce reduced iron by successive heat of numerous reduced iron raw materials 2, each of which contains carbonaceous reducing agent and iron oxide. Each of the reduced iron raw materials 2 is formed in a spherical shape but does not have to be a perfect sphere. This point will be mentioned later. It is preferable that each of the reduced iron raw materials 2 is subject to pre-drying treatment.

The reduced iron production device includes a traveling hearth reduction-melting furnace 10, a plurality of raw material charging units 12, and a discharging unit 14. The reduction-melting furnace 10 produces reduced iron (metal iron) by treating the reduced iron raw materials 2 charged to the inside thereof. Specifically, performed in the reduction-melting furnace 10 are temperature-raising, reduction, melting, aggregation, slag separation, cooling, and the like on the iron oxide. The raw material charging units 12 charge each of the reduced iron raw materials 2 successively into the reduction-melting furnace 10 from respective positions different from each other. The discharging unit 14 discharges the reduced iron and the slag that are produced in the reduction-melting furnace 10 to outside of the reduction-melting furnace 10.

The reduction-melting furnace 10 includes a hearth 16, a hearth covering material 18, a furnace body 20, and a not-graphically-shown hearth driving device. The hearth 16 and the furnace body 20 are composed of, for example, refractories containing alumina as a major component.

The hearth 16 has an annular shape enclosing a circular space in the inside thereof with a constant width radially thereof. The hearth driving device drives the hearth 16 so as to rotate the hearth 16 at a predetermined speed in a predetermined direction (counterclockwise in FIG. 2) around a vertical axis which is a central axis of the hearth 16. The hearth 16 according to this embodiment is, therefore, capable of traveling at a predetermined speed along the rotational circumferential direction thereof.

The hearth covering material 18 is spread on the hearth 16 for protecting the hearth 16, specifically for inhibiting the hearth 16 from direct contact with the reduced iron raw materials 2. The hearth covering material 18 is composed of numerous powder elements. The hearth covering material 18 only has to be capable of preventing slags from infiltrating the refractory constituting the hearth 16 and to be renewable. For example, the hearth covering material 18 is suitably formed of at least one kind of a compound selected from the group consisting of a magnesium oxide compound, a silicon oxide compound, an aluminum oxide compound, iron oxide compound, and a carbon substance. Each of the reduced iron raw materials 2 charged into the reduction-melting furnace 10 by each of the raw material charging units 12 will be set on the hearth covering material 18 as described below.

The furnace body 20 integrally has an inside wall 22, an outside wall 23, and a ceiling 24. The inside wall 22 and the outside wall 23 stand up from an inside edge and an outside edge of the hearth 16, respectively. The hearth 16 is connected to the two side walls 22, 23 so as to make respective displacements relative to the two side walls 22, 23 in the rotational direction of the hearth 16 (hearth travel direction). The ceiling 24 is located over the hearth 16 so as to bridge respective upper ends of the two side walls 22, 23, while having a constant thickness. The vertical dimension from the upper surface of the hearth 16 (which is exactly the upper surface of the hearth covering material 18) to the lower surface 24*a* of the ceiling 24, namely, the ceiling height, is determined in view of preventing the hearth covering material 18 from scattering due to increase in the flow rate of the in-furnace gas and clogging caused by adhering substances and the like. The ceiling height is preferably at least 100 mm or more, typically 200 mm or more.

The reduced iron production device further includes a hearth covering material resupplying device 26 shown in FIGS. 1 and 3. This hearth covering material resupplying device 26 resupplies new hearth covering material 18 in an amount corresponding to the amount of the hearth covering material 18 having been discharged together with the metal iron and the slags in the discharging unit 14, onto the hearth 16 at appropriate times.

The reduction-melting furnace 10 further includes a plurality of burners 28. These burners 28 are provided at a plurality of positions arranged along the travel direction of the hearth 16, respectively, to perform combustion of fuels at the respective positions. The heat generated by the combustion is transmitted by radiation or the like to each of the reduced iron raw materials 2 that are successively charged into the furnace, contributing to reduction and melting of the reduced iron raw materials 2.

As shown in FIG. 3, the reduction-melting furnace 10 includes a plurality of partition walls 31, 32 and 33, which partition the inside space of the reduction-melting furnace 10 into a plurality of zones that are arranged in the travel direction of the hearth 16. The plurality of zones include a heating zone Z1, a reduction zone Z2, a melting zone Z3 and a cooling zone Z4. In the heating zone Z1, respective temperatures of the charged reduced iron raw materials 2 are raised. In the reduction zone Z2, the reduced iron raw materials 2 are reduced. In the melting zone Z3, the reduced iron raw materials 2 are further heated to be melted, so that the reduced iron is separated from the slag and aggregated to become granular melted metal iron. The melted metal iron is cooled by a cooling device 34 provided in the cooling zone Z4 to be thereby solidified. All of respective treatments on the reduced iron raw materials 2 in the zones Z1 to Z4 are carried out on the hearth covering material 18.

The discharging unit 14 is disposed downstream of the cooling zone Z4. The discharging unit 14 includes, for example, a screw conveyor and discharges the metal iron solidified in the cooling zone Z4 as well as the slag and the like to outside of the reduction-melting furnace 10. The discharged metal iron as well as the slags and the like are brought into a discharge hopper 36 and separated from each other by a not-graphically-shown separation device. Through the series of steps described above, there is produced granular metal iron having an extremely small content of slag components.

Next will be described details of each of the raw material charging units 12, with reference to FIGS. 4 to 6.

Figure 4:
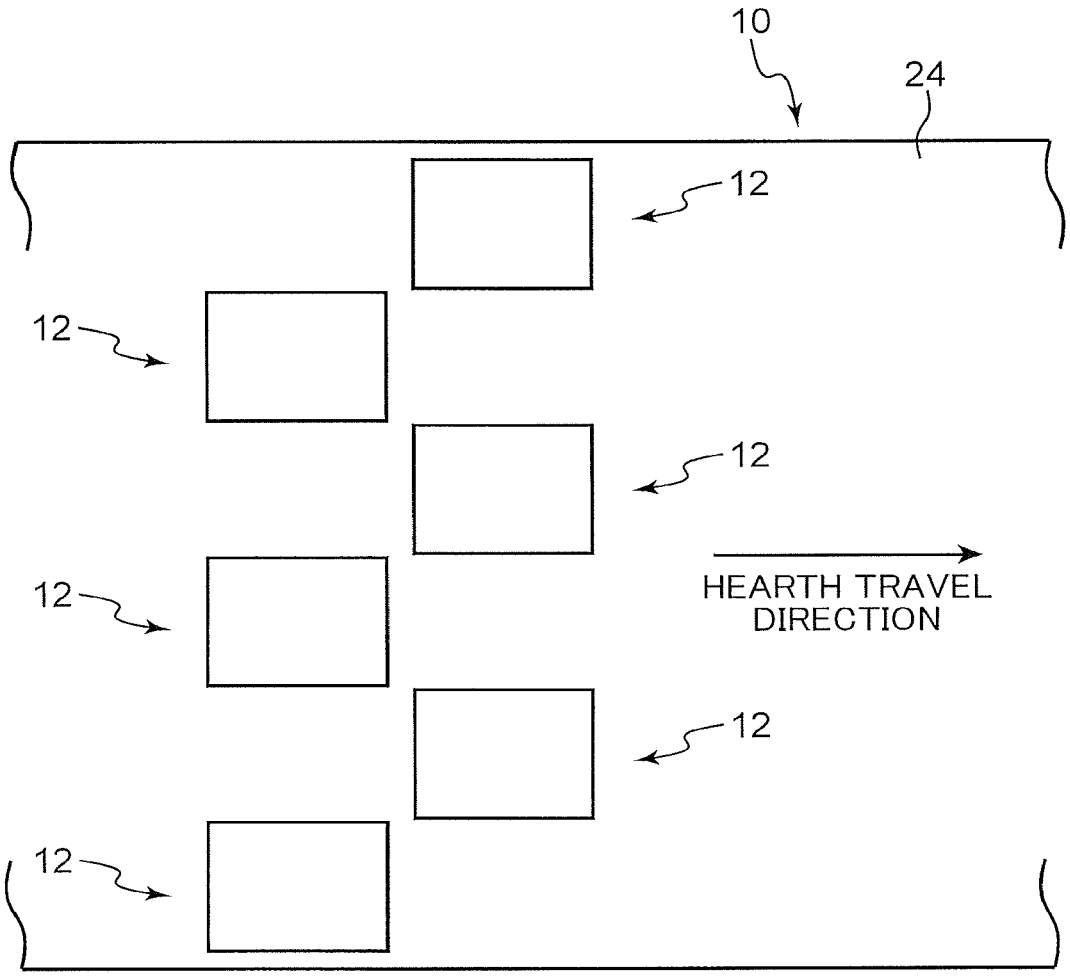
FIG. 4 is a plan view showing an arrangement of a plurality of raw material charging units included in the reduced iron production device.

As shown in FIG. 4, the raw material charging units 12 according to the present embodiment are disposed at a plurality of staggered positions, respectively, in the ceiling 24 of the reduction-melting furnace 10, and charge the reduced iron raw materials 2 at the respective positions. However, the specific number and arrangement of the raw material charging units in the reduced iron production device according to the present invention are not limited. For example, all the reduced iron raw materials may be inserted into the reduction-melting furnace through a single raw material charging unit.

Each of the raw material charging units 12 includes an inclination surface 40 formed in the inside of the ceiling 24, an continuation member 42 for extending the inclination surface further upward beyond the inclination surface 40, and a raw material supplying unit 44.

In the present embodiment, the inclination surface 40 is a flat surface, inclined downward along the travel direction of the hearth 16. The lower end of the inclination surface 40 in the present embodiment coincides with the lower surface 24*a* of the ceiling 24, but the lower end may be located on the upper side of the lower surface 24*a*. In other words, the inclination surface 40 may be terminated at a position above the lower surface 24*a*. Each of the reduced iron raw materials 2 is allowed to descend along the inclination surface 40 so as to make rolling action on the inclination surface 40 (the action may include sliding) and is thereafter released downward from the lower surface 24*a* of the ceiling 24. Upon the release, each of the reduced iron raw materials 2 is given a horizontal velocity corresponding to an inclination angle of the inclination surface 40. In the present embodiment, the ceiling 24 is formed with a through-hole 46 passing through the ceiling 24 at the aforesaid inclination angle, and the surface under the through-hole 46 forms the inclination surface 40.

The inclination surface 40 may be formed by the surface of the refractory constituting the ceiling 24 or may be formed by a covering material that covers the surface of the refractory. In the case of use of the covering material, the state of descent of each reduced iron raw material 2 can be adjusted by selection of the material property thereof. For example, setting the dynamic friction coefficient of the inclination surface 40 to the reduced iron raw materials 2 to a small value (for example, to be 0.4 or less) or setting the repulsion coefficient to be small makes it possible to suppress the bound of each of the reduced iron raw materials 2 on the inclination surface 40 to thereby stabilize the position at which the reduced iron raw material 2 will fall onto the hearth covering material 18.

The continuation member 42 according to the present embodiment is made of a prismatic tube material, having a lower surface forming a continuation inclination surface 48. The continuation member 42 is inserted obliquely into the upper part of the through-hole 46 to bring the continuation inclination surface 48 into continuity with the inclination surface 40. Specifically, there is provided a stair corresponding to the thickness of the continuation member 42 between the upper part of the through-hole 46 and a site located therebelow, to thereby ensure the continuity of the two inclination surfaces 48, 40. This continuation member 42 can be omitted in some cases.

Neither of the inclination surface 40 and the continuation inclination surface 48 is limited to a flat surface. For example, each of them may be a curved surface having a curvilinear shape as viewed from the sides of the reduction-melting furnace 10. In this case, each of the inclination surfaces, if having such a curved shape that the tangential direction of the inclination surfaces approaches the horizontal direction as goes downward, allows the traveling direction of the reduced iron raw materials 2 that are released from the lower surface 24*a* of the ceiling 24 to be directed at an angle closer to the horizontal direction than a general repose angle. Besides, the shape of the inclination surfaces 40, 48 as viewed in the direction along the inclination thereof may be a horizontal straight line or may be a straight line or a curved line including concavities and convexities. For example, the shape may include a plurality of laterally arranged grooves each having a width allowing the reduced iron raw materials 2 to pass along the groove. In any case, it is preferable that the continuation inclination surface 48 has a shape that corresponds to the shape of the inclination surface 40 to be continuous therewith.

The inclination angle of the inclination surfaces 48, 40 can be arbitrarily set; when each of the inclination surfaces 48, 40 is a flat surface, it is preferable that the inclination angle of the inclination surfaces 48, 40 is an angle larger than the repose angle, that is, an angle larger than the angle which surely prevents the reduced iron raw materials 2 from holdup on the inclination surfaces 48, 40, generally an angle of 36° or more. Besides, the inclination angle is preferably an angle that allows the reduced iron raw materials 2 to surely receive a reaction force from the inclination surfaces 48, 40, that is, an angle that allows the reduced iron raw materials 2 to keep surely contact with the inclination surfaces 48, 40, typically, 60° or less. Even if the inclination angle is less than 36°, addition of means for preventing the reduced iron raw materials 2 from holdup on the inclination surfaces, for example, means for assisting the reduced iron raw materials 2 to descent along the inclination surfaces enables the reduced iron raw materials 2 to be surely released from the lower surface 24*a* of the ceiling 24.

The raw material supplying unit 44 is designed to supply the reduced iron raw materials 2 successively to the inclination surfaces 48, 40 and to let the reduced iron raw materials 2 descend along the inclination surfaces 48, 40. The raw material supplying unit 44 according to the present embodiment includes a supply hopper 50 that receives the reduced iron raw materials 2 provided in a large number, a feeder tray 52 that receives the reduced iron raw materials 2 supplied from this supply hopper 50 and is connected to the continuation member 42, and a vibration applying device 54 that imparts vibration to the feeder tray 52 to let the reduced iron raw materials 2 fall successively from the feeder tray 52 to the continuation member 42.

A structure for interconnecting the continuation member 42 and the feeder tray 52 is not particularly limited. In the example shown in FIG. 6, the two are connected via a flange 56; however, a water seal may be provided between the two. In the case of omission of the continuation member 42, the raw material supplying unit may be connected directly to the ceiling 24.

Next will be described a function of the reduced iron production device, that is, a reduced iron production method by use of the device.

First, numerous reduced iron raw materials 2, that is, a plurality of spherical materials each containing carbonaceous reducing agent and iron oxide, are prepared. The "spherical" as referred to herein only has to be spherical enough to allow the reduced iron raw materials 2 to make rolling action after landing on the hearth covering material 18 in the reduction-melting furnace 10 as will be described later; each of the reduced iron raw materials 2, therefore, does not have to be a perfect sphere. Generally, it is preferable that any arbitrary section passing through the center of the reduced iron raw material 2 has a circularity of 0.7 or more. Each of the reduced iron raw materials 2 having a section with such a high circularity can make smooth rolling action also on the inclination surfaces 48, 40, which stabilizes the position of fall of the reduced iron raw materials 2 onto the hearth covering material 18.

The diameter of each of the reduced iron raw materials 2 can be appropriately selected, thus not being limited. Typically, the preferable diameter is 19 mm or more and 27 mm or less. A reduced iron raw material 2 with a diameter of 19 mm or more has a relatively large size with respect to the amount of the scattering hearth covering material 18, which makes the degree of the embedment thereof be small. Besides, the particle size of 27 mm or less restricts the extension width of the time that is required in reduction, melting, aggregation, and slag separation from being superior to the rate of increase in the reduced iron weight per unit area on the hearth, thus suppressing decrease in the productivity due to the superiority.

The thus prepared numerous reduced iron raw materials 2 are put into the supply hopper 50 and successively supplied through the feeder tray 52 to the continuation member 42 (or inclination surface 40 of the ceiling 24 in the case of omission of the continuation member 42). The supplied reduced iron raw materials 2 descend along the inclination surfaces 48, 40 with their respective rolling actions on the inclination surfaces 48, 40 inclined toward the travel direction of the hearth 16, and thereafter become free from the restraint by the inclination surfaces 48, 40 to be released at the time point when the reduced iron raw materials 2 reach the lower surface 24*a* of the ceiling 24, landing on the hearth covering material 18.

Upon the release, each of the reduced iron raw materials 2 is given a horizontal velocity corresponding to the inclination angle of the inclination surfaces 48, 40 in addition to the downward velocity given by gravity. The horizontal velocity, if being somewhat greater than the travel speed of the hearth 16, allows the reduced iron raw material 2 to make rolling action in the travel direction of the hearth 16 after landing on the hearth covering material 18, that is, to further escape in the travel direction of the hearth 16 from the position of landing, as shown in FIGS. 5 and 6. This rolling action, thus, makes it possible to prevent the succeeding reduced iron raw material 2 from being stacked onto the preceding reduced iron raw material 2 or to prevent the preceding reduced iron raw material 2 from embedment into the hearth covering material 18 due to fall of the succeeding reduced iron raw material 2.

In other words, the magnitude of the horizontal velocity to be given to each of the reduced iron raw materials 2 only has to be set enough to ensure the rolling action of the reduced iron raw material 2 after the reduced iron raw material 2 lands on the hearth covering material 18. Specifically, the magnitude of the horizontal velocity may be set in accordance with various conditions such as the size and specific weight of the reduced iron raw material 2, the vertical speed of the reduced iron raw material 2 releasing from the lower surface 24*a* of the ceiling 24, the distance of fall of the reduced iron raw material 2 to the hearth covering material 18, and the material property of the hearth covering material 18 and the like.

Figure 7:
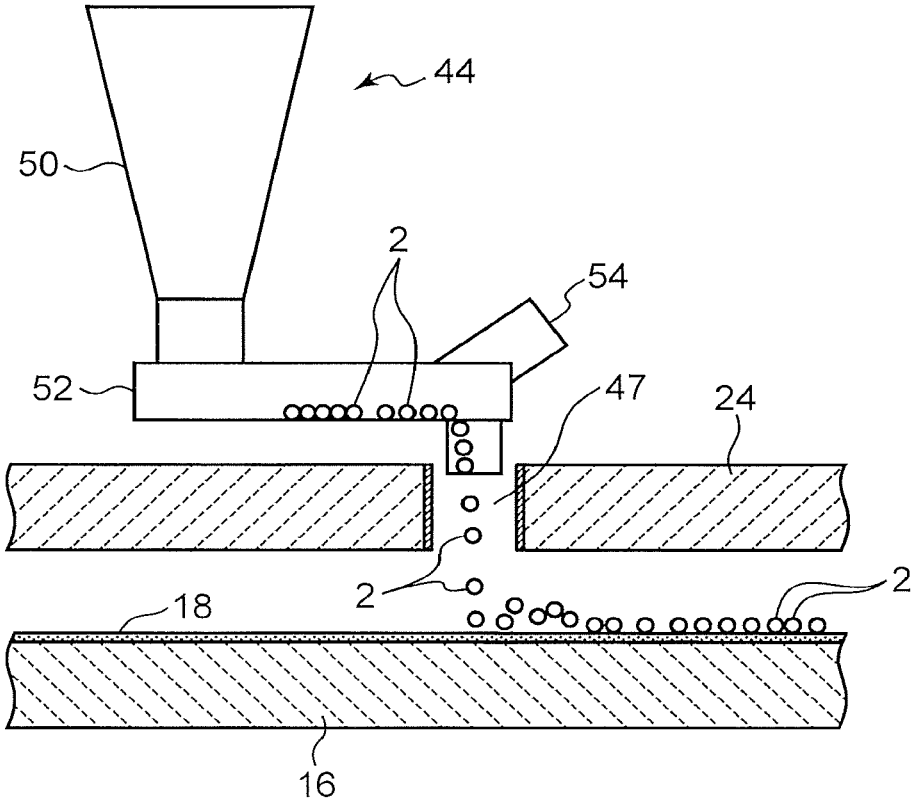
FIG. 7 is a sectional view showing an essential part of a reduced iron production device according to a comparative example.
Figure 8:
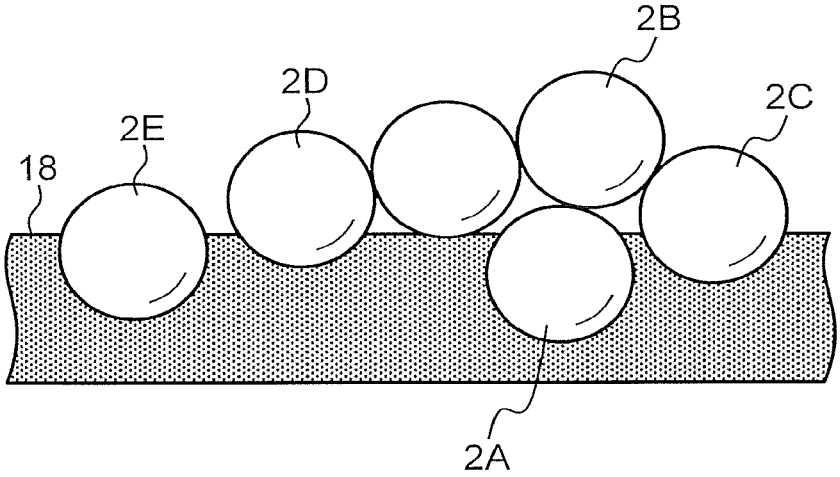
FIG. 8 is a sectional view showing an example of a state of the reduced iron raw material having been charged into the reduction-melting furnace.

The effect produced by the rolling action of the reduced iron raw material 2 after landing from the lower surface 24*a* of the ceiling 24 while being given such a horizontal velocity will be described in comparison with a device according to a comparative example such as shown in FIG. 7. The device shown in FIG. 7 is designed to simply let the reduced iron raw materials 2 that are successively supplied from the raw material supplying unit 44 fall freely and vertically onto the hearth covering material 18 through the through-hole 47 of the ceiling 24. According to this device, the succeeding reduced iron raw material 2 is likely to collide against the preceding reduced iron raw material 2 in the case where the travel speed of the hearth 16 is low compared with the interval of respective supplies of reduced iron raw materials 2. This makes stacking such as the reduced iron raw materials 2A, 2B shown in FIG. 8 and/or embedment into the hearth covering material 18 such as the reduced iron raw materials 2A, 2C, 2D, 2E be more likely to occur. The stacking and the embedment considerably decreases the contact area of each of the reduced iron raw materials 2A to 2E with the in-furnace high-temperature gas or the heat-receiving area which is an area at which each of the reduced iron raw materials 2A to 2E receives the heat given thereto by radiation, being factor to lower the treatment efficiency.

Figure 9:
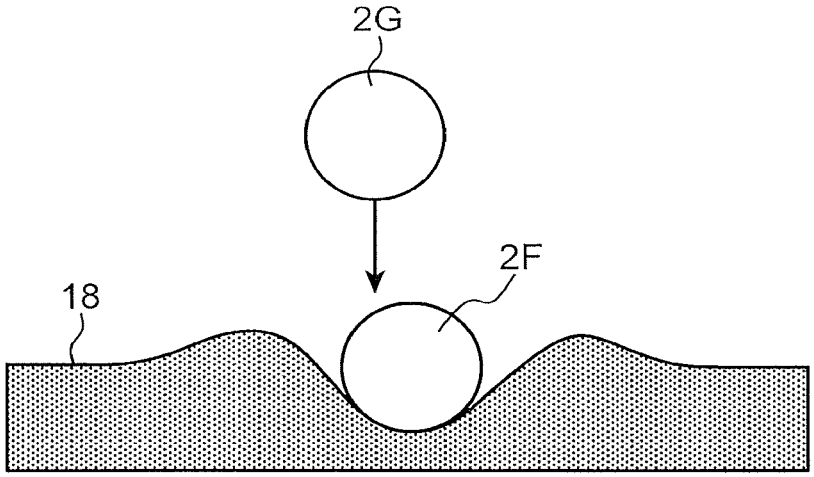
FIG. 9 is a sectional view for describing about an embedment of the preceding reduced iron raw material due to the fall of a succeeding iron raw material onto a preceding reduced iron raw material, the sectional view showing a state before the fall.
Figure 10:
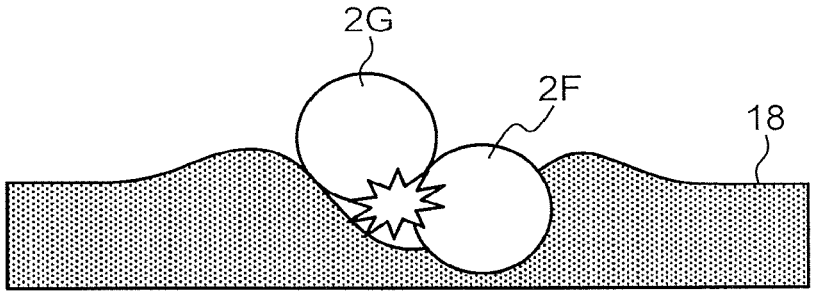
FIG. 10 is a sectional view for describing about an embedment of the preceding reduced iron raw material due to the fall of a succeeding iron raw material onto a preceding reduced iron raw material, the sectional view showing a state after the fall.
Figure 11:
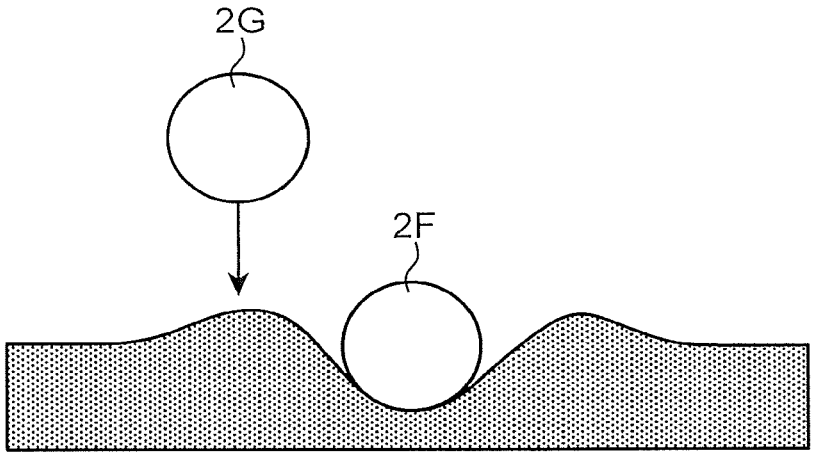
FIG. 11 is a sectional view for describing about an embedment of the preceding reduced iron raw material due to scattering of hearth covering material involved by the fall of a succeeding reduced iron raw material into a neighborhood of a preceding reduced iron raw material, the sectional view showing a state before the fall.
Figure 12:
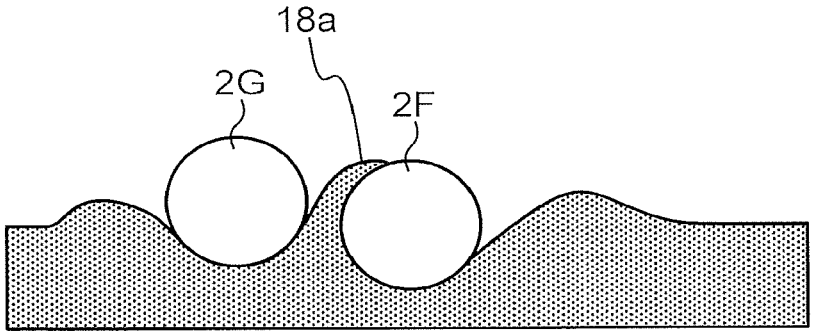
FIG. 12 is a sectional view for describing about an embedment of the preceding reduced iron raw material due to scattering of hearth covering material involved by the fall of a succeeding reduced iron raw material into a neighborhood of a preceding reduced iron raw material, the sectional view showing a state after the fall.

The embedment of the reduced iron raw material is caused not only by the fall of the reduced iron raw material itself onto the hearth covering material 18 but also by the fall of the succeeding reduced iron raw material, and the latter case is rather conspicuous. FIGS. 9 to 12 show a mechanism by which the fall of the succeeding reduced iron raw material 2G onto the hearth covering material 18 causes embedment of the preceding reduced iron raw material 2F into the hearth covering material 18. The succeeding reduced iron raw material 2G having fallen down onto the preceding reduced iron raw material 2F as shown in FIG. 9 presses the reduced iron raw material 2F into the hearth covering material 18 to bring it into embedment as shown in FIG. 10. Furthermore, also the succeeding reduced iron raw material 2G having fallen down not onto the preceding reduced iron raw material 2F but into the neighborhood thereof as shown in FIG. 11 causes a part 18*a* of the hearth covering material 18 to scatter to cover the preceding reduced iron raw material 2F as shown in FIG. 12, thereby finally causing embedment of the reduced iron raw material 2F.

In contrast, the horizontal rolling action of the reduced iron raw material 2 that has been given a horizontal velocity such as shown above enables any of the embedment caused by the mechanism such as shown in FIGS. 9 to 12 to be prevented. In detail, even if the hearth travel speed is somewhat low, the preceding reduced iron raw material 2F can escape largely forward through its rolling action by the time when the succeeding reduced iron raw material 2G will fall onto the hearth covering material 18; this makes embedment due to the fall of the reduced iron raw material 2G onto the reduced iron raw material 2F or into the neighborhood thereof be less likely to occur. Although the succeeding reduced iron raw material 2G can approach the preceding reduced iron raw material 2F through its rolling action, the collision, even if occurring, will be weak and horizontal; furthermore, the rolling action involves no considerable scattering of the hearth covering material 18. Thus, there hardly occurs any embedment of the preceding reduced iron raw material 2F due to the collision or scattering of the hearth covering material 18.

The charge of the reduced iron raw materials 2 with thus effectively suppressing the stacking of the reduced iron raw materials 2 onto each other and the embedment of the reduced iron raw materials 2 allows sufficient heat to be input into the reduced iron raw materials 2. The heat input enables the reduced iron raw materials 2 to be subject to favorable heating treatments (temperature-raising, reduction, and melting treatments) in the respective zones Z1 to Z3 in a short period of time, and the reduced iron thereafter cooled in the cooling zone Z4 can be discharged by the discharging unit 14 as metal iron having a high quality.

Specifically, performed is a measurement of the reaction time of reduced iron raw materials (period of time from the time at which the reduced iron raw materials are put into the furnace and start being heated until the time at which the separation of the reduced iron from the slags is completely ended), corroborating that the treatment of a reduced iron raw material half of which is embedded in the hearth covering material 18 take a reaction time about 1.35 times that for the treatments of a reduced iron raw material with no embedment in the hearth covering material 18 at all. The prevention of the embedment, therefore, enables the reaction time to be considerably shortened.

As described above, the method and the device according to the present embodiment enable metal iron with high quality to be produced in a short period of time through respective rolling actions of the reduced iron raw materials 2 on the hearth covering material 18; for the rolling action, it is preferable to give each of the reduced iron raw materials 2 a horizontal velocity large enough to allow the reduced iron raw materials 2 to be incident onto the hearth covering material 18 at an angle of 60° or less. The incidence angle of 60° or less enables the magnitude of the horizontal velocity to be ½ or more of the incidence speed, thereby further ensuring the rolling action of the reduced iron raw material 2 in the hearth travel direction against sinking of the reduced iron raw material 2 into the hearth covering material 18 caused by fall of the reduced iron raw material 2 onto the hearth covering material 18. It is preferable to set the inclination angle of the inclination surface 40 or the inclination surfaces 48, 40 from such a viewpoint.

Means for imparting a horizontal velocity such as described above to the reduced iron raw material is not limited to the rolling action of the reduced iron raw material on the inclination surfaces. For example, the horizontal velocity can be imparted to the reduced iron raw material by blowing a high-pressure gas horizontally onto the reduced iron raw material having been released vertically from the lower surface of the ceiling. The rolling action of the reduced iron raw material on the inclination surfaces provided in the ceiling such as described above, however, makes it possible to give a horizontal velocity to the reduced iron raw material released from the lower surface of the ceiling with no addition of a complex or large-scale equipment that requires heat resistance in a high-temperature region below the ceiling. This makes it possible to restrain the reduced iron raw materials from stacking onto each other or embedment into the hearth covering material without decrease in the reliability of the charging equipment or considerable rise in the costs and without giving considerable adverse effects on the flow of the gas in the furnace below the lower surface of the ceiling.

Examples

Figure 5:
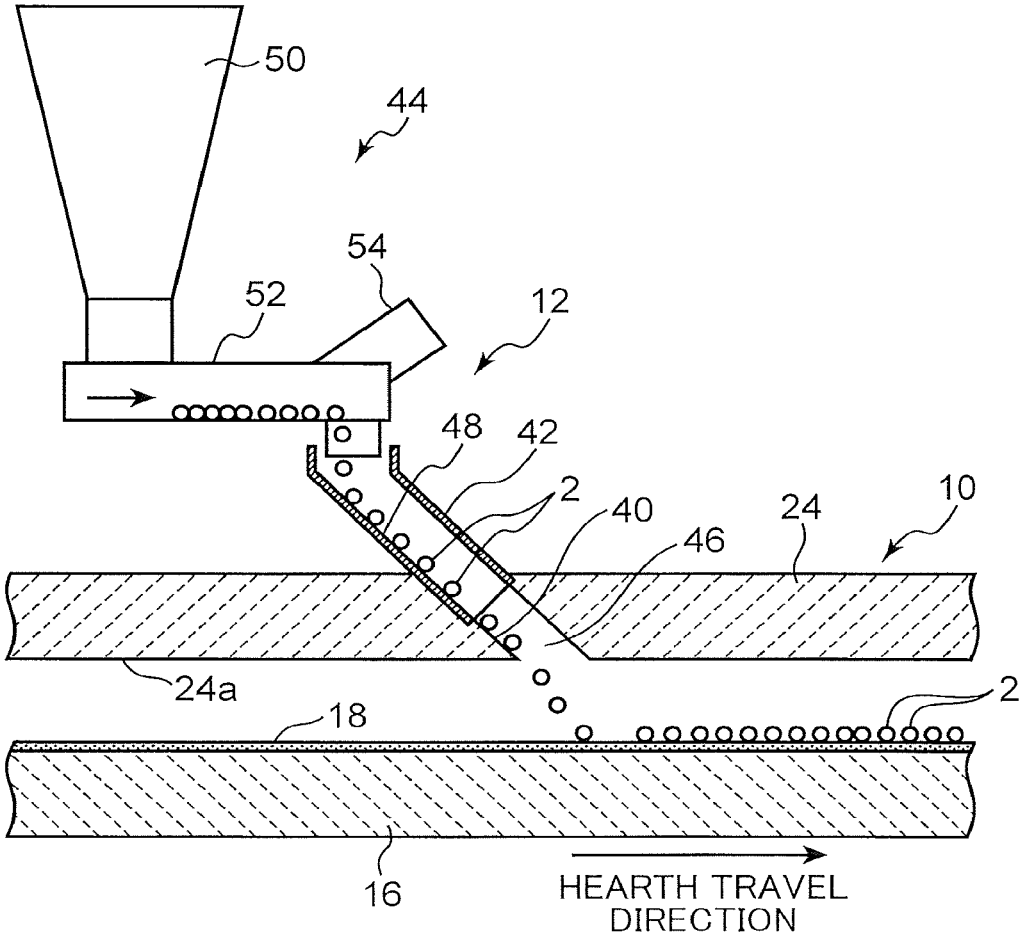
FIG. 5 is a sectional view showing the raw material charging unit and a site of the reduction-melting furnace in a neighborhood thereof, the sectional view taken along a central line in the width direction of the reduction-melting furnace.
Figure 6:
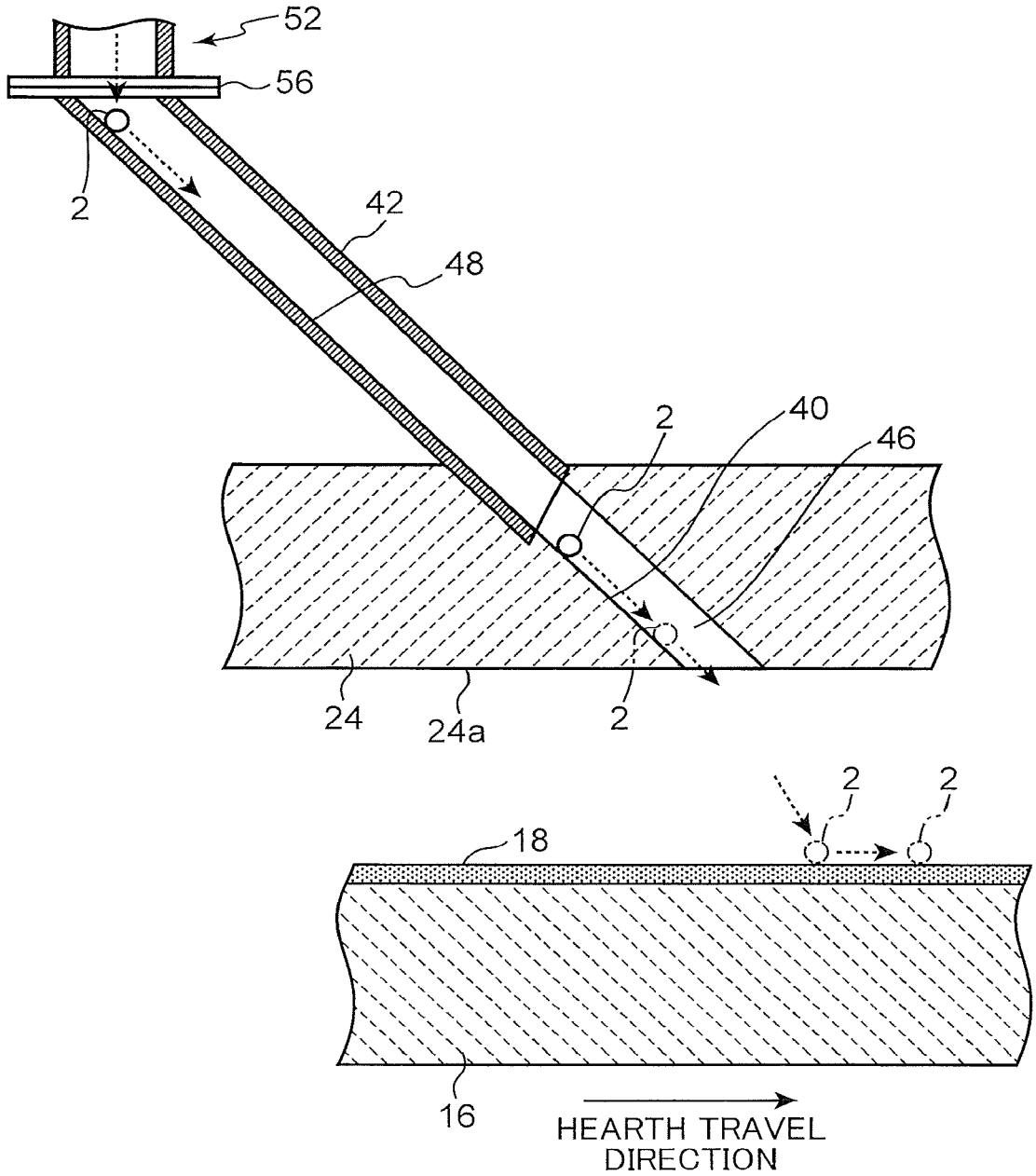
FIG. 6 is a sectional view showing an essential part of the site shown in FIG. 5.

As examples according to the present invention and comparative examples, conducted are experiments according to the embodiment shown in FIGS. 5, 6 and the device of free fall type such as shown in FIG. 7, under the following conditions on each of the devices.

(1) Reduced Iron Raw Material

Circularity of arbitrary section: 0.8 or more (common)

Diameter: 3 kinds of 15 mm, 19 mm, and 23 mm (Examples)

Diameter: 2 kinds of 15 mm and 23 mm (Comparative Examples)

(2) Hearth Covering Material

Material property: anthracite (common)

Particle size: 3.35 mm or less 100 Wt % (common)

Layer thickness: 15 mm (common)

(3) Vertical Distance of Fall

Case of comparative examples: 900 mm

Case of examples: 1400 mm (4) Hearth Travel Speed

Case where raw material diameter is 23 mm: 7.6 m/min (common)

Case where raw material diameter is 19 mm: 9.2 m/min (examples only)

Case where raw material diameter is 15 mm: 11.6 m/min (common)

(5) Inclination Surface (Examples only)

Inclination angle: 45°

Material property: refractory (same as in ceiling)

Length: 1000 mm

In the above experiments, data were collected on the relationship between the spread density coefficient and the embedment ratio of the reduced iron raw materials on the hearth covering material. Here, the "spread density coefficient" refers to the ratio of actual spread density to the maximum spread density which is the spread density (weight per unit area) of the reduced iron raw materials that are arranged in the densest state on the hearth covering material. The "embedment ratio" refers to the ratio of the weight of the reduced iron raw materials half or more of which is embedded in the hearth covering material (reduced iron raw materials 2A, 2E in the example shown in FIG. 8) to the total weight of the supplied reduced iron raw materials.

Figure 13:
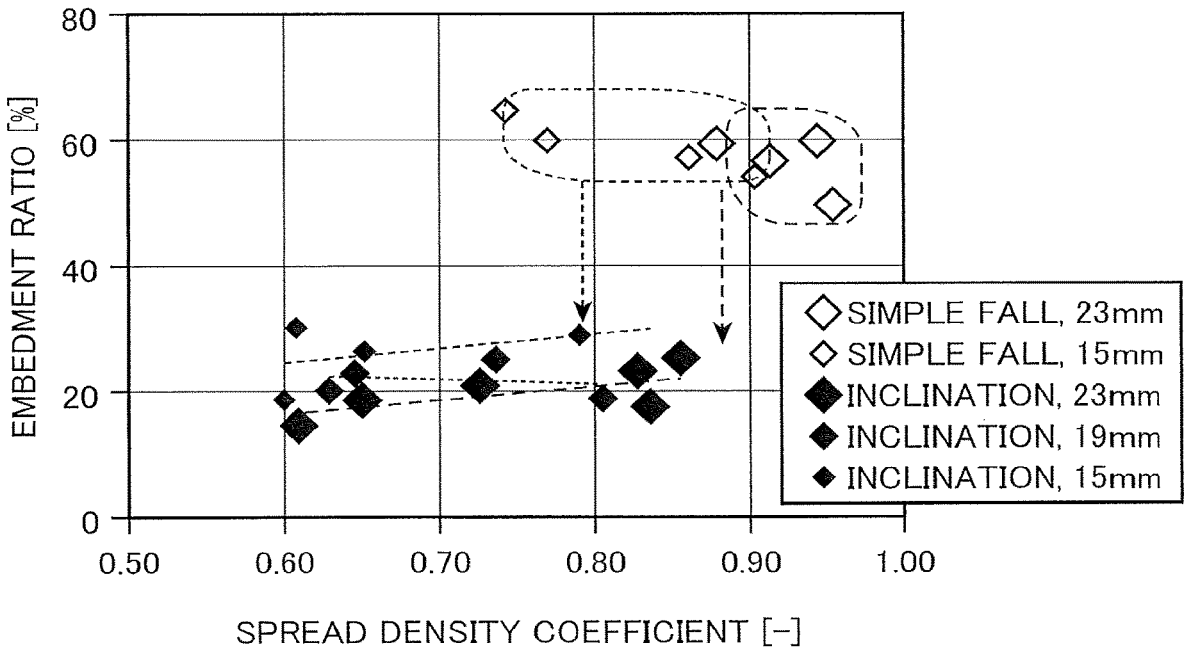
FIG. 13 is a graph showing a relationship between a spread density coefficient and an embedment ratio of the reduced iron raw material in the embodiments and in the comparative examples.

The results of the experiments are shown in FIG. 13. FIG. clearly shows that the embedment ratio according to the examples in which inclination was given in the release direction of the reduced iron raw materials is considerably lower than that of the comparative examples in which the reduced iron raw materials are let fall freely, with the comparison under the same spread density coefficient, irrespective of whether the spread density coefficient is large or small or irrespective of whether the diameter of the reduced iron raw material is large or small. This effect seems to be caused by the rolling action of each of reduced iron raw materials, the rolling action effectively suppressing the embedment of the preceding reduced iron raw material due to collision of the reduced iron raw materials to each other or scattering of the hearth covering material such as shown in FIGS. 9 to 12.

As described above, provided are a method and a device for producing reduced iron by charging a plurality of reduced iron raw materials, each of which contains carbonaceous reducing agent and iron oxide, into a traveling hearth reduction-melting furnace to treat the reduced iron raw materials, the method and device enabling each of the reduced iron raw materials supplied onto a hearth covering material to receive sufficient heat input on the hearth covering material to improve the treatment efficiency thereof without decrease in the reliability of the equipment or considerable rise in the costs.

Provided is a method for producing reduced iron, the method including: a step of successively charging a plurality of spherical reduced iron raw materials, each of which contains carbonaceous reducing agent and iron oxide, into a reduction-melting furnace having a hearth that travels in a specific direction, a ceiling located over the hearth, and a hearth covering material that is made of powder spread on the hearth, and setting the reduced iron raw materials on the hearth covering material, and a step of performing successive reduction processing on the reduced iron raw materials on the hearth covering material with travel of the hearth to thereby produce reduced iron and discharge the produced reduced iron to outside of the reduction-melting furnace. The step of setting the reduced ion raw materials on the hearth covering material includes releasing the reduced iron raw materials downward from a lower surface of the ceiling and letting the reduced iron raw materials fall onto the hearth covering material while giving a horizontal velocity to the reduced iron raw materials, the horizontal velocity having a horizontal direction that is equal to the direction of the travel of the hearth and being greater than a speed of the travel of the hearth, to the reduced iron raw materials, to thereby bring the reduced ion raw materials into rolling motion in a direction of the horizontal velocity on the hearth covering material.

The term "spherical reduced iron raw materials" as referred to herein is not intended to limit each of the reduced iron raw materials to a perfect sphere. The scope of the "spherical reduced iron raw materials" according to the present invention encompasses reduced iron raw materials each of which is not exactly a sphere but close to a sphere enough to be able to make rolling action on the powdery hearth covering material, for example, reduced iron raw material in which any arbitrary section passing through the center thereof has a high circularity enough to satisfy the aforementioned conditions.

The rolling action of the reduced iron raw material on the hearth covering material effectively suppresses stacking of the succeeding reduced iron raw material onto the preceding reduced iron raw material and embedment of the reduced iron raw materials into the hearth covering material, thereby allowing sufficient heat to be input into each of the reduced iron raw materials. Specifically, each of the reduced iron raw materials successively supplied onto the hearth covering material makes rolling action in the hearth travel direction from the point of fall thereof to thereby effectively avoid stack of the succeeding reduced iron raw material onto the reduced iron raw material. Besides, the rolling action can suppress not only embedment of the reduced iron raw material at the point of fall thereof but also embedment caused by the reduced iron raw material that falls erroneously onto the preceding reduced iron raw material to press the preceding reduced iron raw material into the hearth covering material and embedment of the preceding reduced iron raw material caused by the powdery hearth covering material that is scattered due to the fall of the succeeding reduced iron raw material to cover the preceding reduced iron raw material.

Moreover, release of the reduced iron raw materials from the lower surface of the ceiling involves neither of decrease in the reliability of the charging equipment, considerable rise in the costs, and turbulence of the gas in a neighborhood of the powdery hearth covering material, differently from a device or a method which uses a member extending downward beyond the lower surface of the ceiling to supply the reduced iron raw materials.

The horizontal velocity preferably has a magnitude enough to make the angle of incidence of each of the reduced iron raw materials onto the hearth covering material be 60° or less. This angle of incidence, giving the reduced iron raw materials a horizontal velocity of ½ or more of the speed of incidence thereof at the time point when the reduced iron raw materials fall onto the hearth covering material, ensures the rolling action of the reduced iron raw materials after landing on the hearth covering material.

The horizontal velocity can be given to the reduced iron raw materials, for example, by providing, in the inside of the ceiling, an inclination surface that is inclined so as to descend in the travel direction of the hearth and has a lower end located at the lower surface of the ceiling or at an upper side of the lower surface, letting the reduced iron raw materials descend along the inclination surface with their respective rolling actions on the inclination surface, and releasing thereafter the reduced iron raw materials from the lower end of the inclination surface. Thus providing an inclination surface in the inside of the ceiling made of a refractory to release the reduced iron raw materials therefrom requires no charge equipment to be disposed in a high-temperature atmosphere, different from the case of further providing a supplying unit extending downward beyond the ceiling toward the hearth covering material, involving no decrease in the reliability of the charging equipment. Besides, there is no need to construct charging equipment with expensive material with a high heat resistance, involving no considerable increase in the costs. Besides, there exists little influence on the flow of the gas in the furnace. Here, rolling action of the reduced iron raw materials on the inclination surface may include some element of sliding.

This method does not exclude extension of the inclination surface upward beyond the ceiling. In particular, providing on the ceiling an continuation member having a continuation inclination surface continuous with the inclination surface provided in the inside of the ceiling, letting the reduced iron raw materials descend successively along the continuation inclination surface and the inclination surface provided in the inside of the ceiling, and releasing thereafter the reduced iron raw materials allow a sufficient runup distance to be secured even with the limited thickness of the ceiling. Moreover, the continuation member, which is provided on the ceiling, requires no high heat resistance and has no influence on the flow of the gas in the furnace. Furthermore, the continuation member allows work for exchange or maintenance thereof to be carried out easily above the ceiling.

Also provided is a device for producing reduced iron by heating a plurality of spherical reduced iron raw materials, each of which contains carbonaceous reducing agent and iron oxide. The device includes: a reduction-melting furnace having a hearth travelable in a specific direction, a ceiling located over the hearth, and a hearth covering material made of powder spread on the hearth, so as to produce reduced iron by successively heating the reduced iron raw materials that are set on the hearth covering material with travel of the hearth; a raw material charging unit that charges the plurality of reduced iron raw materials successively into the reduction-melting furnace to set the reduced iron raw materials on the hearth covering material; and a discharging unit that discharges the reduced iron produced in the reduction-melting furnace. The raw material charging unit releases the reduced iron raw materials downward from a lower surface of the ceiling and lets the reduced iron raw materials fall onto the hearth covering material while giving a horizontal velocity to each of the reduced iron raw materials, the horizontal velocity having a horizontal direction that is equal to the direction of the travel of the hearth and being greater than a speed of the travel of the hearth, to thereby bring the reduced iron raw materials into rolling action in a direction of the horizontal velocity on the hearth covering material.

Specifically, the raw material charging unit preferably includes an inclination surface that is provided in the inside of the ceiling and inclined downward in the travel direction of the hearth, the inclination surface having a lower end located at the lower surface of the ceiling or on an upper side of the lower surface, and a raw material supplying unit that supplies the plurality of reduced iron raw materials successively to the inclination surface to let the reduced iron raw materials descend along the inclination surface and to release the reduced iron raw materials from the lower end of the inclination surface downward of the ceiling.

The raw material charging unit may further include an inclination surface that is extended to outside of the ceiling, that is, above or below the ceiling, in addition to the inclination surface provided in the inside of the ceiling. Specifically, the device may further include a continuation member provided on the ceiling, the continuation member having a continuation inclination surface that is continuous with the inclination surface provided in the inside of the ceiling, and the raw material supplying unit may supply the reduced iron raw materials to the continuation inclination surface to let the reduced iron raw materials descend successively along the continuation inclination surface and the inclination surface provided in the inside of the ceiling and be released thereafter.

The angle of the inclination surface can be suitably set. Typically, the preferable angle is 36° or more and 60° or less. An inclination angle of 36° or more effectively hinders the supplied reduced iron raw materials from stoppage and holdup on the inclination surface. Besides, an inclination angle of 60° or less enables the reduced iron raw materials to descend along the inclination surface while surely keeping contact of the reduced iron raw materials with the inclination.

The invention claimed is:

1. A method for producing reduced iron, the method comprising:

successively charging a plurality of spherical raw materials capable of forming reduced iron, each of which contains carbonaceous reducing agent and iron oxide, into a reduction-melting furnace having a hearth that travels in a specific direction, a ceiling located over the hearth, and a hearth covering material that is made of powder spread on the hearth, and setting the raw materials on the hearth covering material; and performing successive reduction processing on the raw materials on the hearth covering material with travel of the hearth to thereby produce reduced iron and discharge the produced reduced iron from the reduction-melting furnace, wherein said setting the raw materials on the hearth covering material includes releasing the raw materials downward from a lower surface of the ceiling and letting the raw materials fall onto the hearth covering material while giving a horizontal velocity, which has a horizontal direction that is equal to the direction of the travel of the hearth and is greater than a speed of the travel of the hearth, to the raw materials, to thereby bring the raw materials into rolling motion in a direction of the horizontal velocity on the hearth covering material.

2. The method according to claim 1, wherein, in said setting the raw materials on the hearth covering material, the horizontal velocity has a magnitude enough to make an angle of incidence of the raw materials onto the hearth covering material be 60° or less.

3. The method according to claim 1, wherein the horizontal velocity is given to each of the raw materials by providing an inclination surface in an inside of the ceiling, the inclination surface being inclined downward in the travel direction of the hearth and having a lower end located at the lower surface of the ceiling or on an upper side of the lower surface, letting the raw materials descend along the inclination surface with respective rolling actions on the inclination surface, and releasing thereafter the raw materials from the lower end of the inclination surface.

4. The method according to claim 3, wherein the horizontal velocity is given to each of the raw materials by providing a continuation member on the ceiling, the continuation member having a continuation inclination surface that is continuous with the inclination surface provided in the inside of the ceiling, letting the raw materials descend successively along the continuation inclination surface and the inclination surface provided in the inside of said ceiling, and releasing thereafter the raw materials.

5. A device for producing reduced iron by heating a plurality of spherical raw materials capable of forming reduced iron, each of which contains carbonaceous reducing agent and iron oxide, the device comprising:

a reduction-melting furnace having a hearth travelable in a specific direction, a ceiling located over the hearth, and a hearth covering material made of powder spread on the hearth, the reduction-melting furnace being capable of producing reduced iron by successively heating the raw materials that are set on the hearth covering material with travel of the hearth;

a raw material charging unit capable of charging the plurality of raw materials successively into the reduction-melting furnace to set the raw materials on the hearth covering material; and a discharging unit capable of discharging the reduced iron produced in the reduction-melting furnace, wherein the raw material charging unit capable of releasing the raw materials downward from a lower surface of the ceiling and lets the raw materials fall onto the hearth covering material while giving a horizontal velocity to each of the raw materials, the horizontal velocity having a horizontal direction that is equal to the direction of the travel of the hearth and being greater than a speed of the travel of the hearth, to thereby bring the raw materials into rolling action in a direction of the horizontal velocity on the hearth covering material.

6. The device according to claim 5, wherein the raw material charging unit includes an inclination surface located in an inside of the ceiling, the inclination surface being inclined downward in the travel direction of the hearth and having a lower end located at the lower surface of the ceiling or on an upper side of the lower surface, and a raw material supplying unit capable of supplying the plurality of raw materials successively to the inclination surface to let the raw materials descend along the inclination surface and to release the raw materials from the lower end of the inclination surface.

7. The device according to claim 6, wherein the raw material charging unit further includes an inclination surface that is extended upward beyond the ceiling in addition to the inclination surface provided in the inside of the ceiling.

8. The device according to claim 7, further comprising a continuation member provided on the ceiling, the continuation member having a continuation inclination surface that is continuous with the inclination surface provided in the inside of the ceiling, wherein the raw material supplying unit is capable of supplying the raw materials to the continuation inclination surface to let the raw materials descend successively along the continuation inclination surface and the inclination surface provided in the inside of said ceiling.

9. The device according to claim 6, wherein the inclination surface has an angle between the inclination surface and the hearth covering material, which is between 36° to 60°.

* * * * *